United States Patent [19]

Mark

[11] 4,358,293

[45] Nov. 9, 1982

[54] COAL-AQUEOUS MIXTURES

[75] Inventor: Seymour Mark, Northampton, Pa.

[73] Assignee: Gulf & Western Manufacturing Co.

[21] Appl. No.: 230,062

[22] Filed: Jan. 29, 1981

[51] Int. Cl.[3] ..... C10L 1/32; C10L 1/18

[52] U.S. Cl. ..... 44/51; 44/77; 252/351; 252/DIG. 1

[58] Field of Search ..... 44/51, 77; 252/351, 252/DIG. 1

[56] References Cited

U.S. PATENT DOCUMENTS

| | | | |
|---|---|---|---|
| 1,390,230 | 9/1921 | Bates | 44/51 |
| 2,231,477 | 9/1940 | Steindorff et al. . | |
| 2,359,325 | 10/1944 | McConnell et al. | 44/66 |
| 2,397,859 | 4/1946 | Hersberger et al. | 44/51 |
| 2,496,582 | 2/1950 | Enyeart | 252/353 |
| 2,671,758 | 3/1954 | Vinograd et al. | 252/18 |
| 2,674,619 | 6/1954 | Lundsted | 252/353 |
| 2,674,619 | 4/1954 | Lundsted | 252/353 |
| 2,677,700 | 5/1954 | Jackson et al. | 252/353 |
| 2,684,338 | 7/1954 | McGowan et al. . | |
| 3,101,374 | 8/1963 | Patton . | |
| 3,210,168 | 10/1965 | Morway . | |
| 3,244,615 | 4/1966 | Huntington | 208/97 |
| 3,376,168 | 4/1968 | Horowitz | 208/97 |
| 3,401,049 | 10/1968 | Horowitz | 208/97 |
| 3,524,682 | 8/1970 | Booth | 208/97 |
| 3,617,095 | 10/1971 | Kenneth | 208/97 |
| 3,620,698 | 11/1971 | Schlinger et al. | 208/97 |
| 3,698,931 | 10/1972 | Horowitz | 208/97 |
| 3,703,481 | 11/1972 | Barker et al. | 256/546 |
| 3,732,084 | 5/1973 | Nixon et al. | 44/51 |
| 3,762,887 | 10/1973 | Clancey et al. | 44/51 |
| 3,764,547 | 10/1973 | Schlinger et al. | 44/51 |
| 3,880,580 | 4/1975 | Horowitz et al. | 427/304 |
| 3,941,552 | 3/1976 | Cottel . | |
| 3,996,026 | 12/1976 | Cole . | |
| 4,033,852 | 7/1977 | Horowitz et al. | 44/1 R |
| 4,088,453 | 5/1978 | Wiese et al. . | |
| 4,101,293 | 7/1978 | Krouse et al. | 44/51 |
| 4,104,035 | 8/1978 | Cole et al. . | |
| 4,158,548 | 6/1979 | Burk et al. | 44/1 R |
| 4,163,644 | 8/1979 | Bowers | 44/51 |
| 4,201,552 | 5/1980 | Rowell | 44/51 |
| 4,217,109 | 8/1980 | Siwerson et al. | 44/1 SR |
| 4,227,994 | 12/1980 | Knebel et al. | 208/8 LE |
| 4,242,098 | 12/1980 | Brau et al. | 44/51 |
| 4,244,699 | 1/1981 | Smith et al. . | |
| 4,248,698 | 2/1981 | Keller | 241/24 |
| 4,249,699 | 2/1981 | Smith et al. | 241/20 |
| 4,251,229 | 2/1981 | Joyo et al. | 44/51 |
| 4,252,540 | 2/1981 | Yamamura et al. | 44/51 |
| 4,252,639 | 2/1981 | Smith et al. | 209/5 |
| 4,253,944 | 3/1981 | Hefner | 209/166 |
| 4,255,155 | 3/1981 | Frankovich | 44/1 R |
| 4,255,156 | 3/1981 | Sun et al. | 44/1 SR |

FOREIGN PATENT DOCUMENTS

| | | | |
|---|---|---|---|
| 1523193 | 8/1978 | United Kingdom | 44/51 |

OTHER PUBLICATIONS

Fuel Extension by Dispersion of Clean Coal in Oil--Government Report No. FE-2694.

Feasibility Study of Molecular Grafting to Solubilize Coal-Government Report No. FE-2020-1.

Cleaning of Eastern Bituminous Coal by the Grinding Froth Flotation and Gradient Magnetic Separation.

Development and Evaluation of Highly Loaded Coal Slurries-2nd International Symposium of Coal-Oil Mixture Combustion Nov. 27-29, 1979.

Encyclopedia of Chemical Technology, Kirk-Othmer (1980) vol. 11 pp. 410-422 and pp. 449-473.

Encyclopedia of Chemical Technology, Kirk-Othmer (1980) vol. 6 pp. 314-322.

*Primary Examiner*—Jacqueline V. Howard

*Attorney, Agent, or Firm*—Bartholomew Verdirame; Thomas E. Harrison, Jr.

[57] ABSTRACT

Coal-aqueous mixture characterized by having high coal solids concentrations are provided. Selected polyalkyleneoxide nonionic surfactants are employed at low concentrations to disperse coal in an aqueous carrier medium to coal solids levels of 70% by weight, or higher. The selected polyalkyleneoxide nonionic surfactants are characterized by having a high molecular weight and a hydrophilic portion comprised of at least about 100 repeating units of ethylene oxide.

57 Claims, No Drawings

COAL-AQUEOUS MIXTURES

FIELD OF THE INVENTION

The present invention relates to dispersions of carbonaceous materials in a carrier medium.

In a more specific aspect, this invention relates to a dispersion of coal in an aqueous carrier medium which is eminently suitable as an energy source.

Still more specifically, this invention relates to the utilization of high molecular weight polyalkyleneoxide nonionic surfactants having at least about 100 ethylene oxide repeating units, as dispersants for forming coal-aqueous mixtures of high coal solids concentrations.

BACKGROUND OF THE INVENTION

Coal as an energy source is in abundant supply. It is estimated that in the United States there is more energy available in coal than in petroleum, natural gas, oil shale and tar sands combined. The substitution of coal for natural gas and oil on a large scale would therefore seem a ready-made solution to our energy problems. Unfortunately, however, unlike oil and gas consumption, coal use is limited not by reserves or production capacity but rather by the extraordinary industrial and regulatory difficulties of burning it in a convenient, efficient and environmentally acceptable manner.

A number of techniques are being explored to provide coal as a more useful energy source. One such technique employs gasification methods such as destructive distillation, to effect the conversion of coal to a low or medium Btu gas. In another approach, high pressure hydrogenation is utilized to liquefy coal to make it more suited for transport, burning and the like.

Another technique suggested, and the one to which the present invention relates, is the technique whereby solid coal particles are dispersed in a fluid carrier medium, such as fuel oil or water to form coal-aqueous or coal-oil mixtures.

Such coal mixtures offer considerable advantages. They are more readily transported then dry solid coal, are more easily stored and are less subject to the risks of explosion by spontaneous ignition, the latter being a significant factor in handling coal. In addition, providing coal in a fluid form can permit its burning in apparatus normally used for burning fuel oil. This can greatly facilitate the transition from fuel oil to coal as a primary energy source, another highly desirable result.

Various coal-oil and coal-aqueous mixtures have been described in the literature. For example, British Pat. No. 1,523,193 discloses a mixture comprised of fuel oil and from 15 to 55% by weight of finely ground coal particles reduced in particle size to 10 microns or finer. The effort required to grind coal to such fine sizes, however, makes the process less economically attractive. Moreover, the use of fuel oil as a carrier medium negates the requirement of lessening our dependence upon fuel oil.

In U.S. pat. No. 3,762,887, there is disclosed a dispersion of coal in an aqueous medium wherein the coal is ground to a defined array of particle sizes, a substantial portion of which being about 325 mesh Tyler Standard screen or even finer. Here again, substantial and selective grinding of the coal is required.

U.S. pat. No. 4,217,109, discloses a technique for cleaning and dispersing coal in water utilizing dispersing agents which by selective adsorption impart different electrical charges to the carbon particles and the impurities. The dispersing agents taught are polyelectrolytes,such as alkali metal and ammonium salts of polycarboxylic acids and polyphosphates.

The article titled "Development and Evaluation of Highly-Loaded Coal Slurries" published in the *2nd International Symposium on Coal-Oil Mixture Combustion,* Nov. 27–29, 1979, teaches coal-aqueous mixtures using coal of bimodal particle size distributions and containing modified starches, biocides and a wetting agent such as TRITON X, an octylphenoxy (ethyleneoxy) ethanol surfactant of low molecular weight. Again, forming bimodal particle size distributions requires significant grinding operations and the inefficiencies incident thereto.

And according to U.S. Pat. No. 3,617,095 a still further method is mentioned in the literature for forming emulsions of bulk solids by admixing the solid, such as coal, with water and oil in the presence of an oxyalkylated octyl phenol emulsifying agent.

Finally, a number of further patents disclose mechanical treatments and dispersants for providing coal in a carrier medium. See, e.g., U.S. pat. Nos. 4,088,453; 4,104,035; 3,620,698; 3,764,547; 3,996,026; 3,210,168 and 3,524,682.

While the art has attempted to provide coal in dispersed fluid form, as evidenced by the above-described procedures, there still remains the need for improving these methods in order to provide coal mixtures without undue mechanical or chemical treatment. It would be highly desirable to provide coal in aqueous mixture form wherein only minor amounts of additive materials are needed to disperse the coal to high solids concentrations of 70% by weight, or higher. It would be further desirable to provide coal-aqueous mixtures wherein the coal is pre-cleaned of impurities so that the resultant mixtures are clean burning or relatively clean burning and thus more environmentally acceptable.

Accordingly, it is an object of the present invention to provide dispersions of coal in a carrier medium.

It is another object of the present invention to provide coal-aqueous mixtures of high coal solids content.

It is a further object of the invention to provide coal-aqueous mixtures of high solids content wherein only minor amounts of additive materials are needed and little mechanical treatment is required.

It is a still further object of the invention to provide coal-aqueous mixtures wherein the dispersed coal is precleaned of impurities so that the resultant mixtures are clean-burning or relatively clean-burning.

A further object of the invention is to provide suitable methods for forming coal-aqueous mixtures.

These and other objects will become apparent from the following summary of the invention, taken in conjunction with the accompanying detailed description.

SUMMARY OF THE INVENTION it has now been surprisingly discovered that certain polyalkyleneoxide nonionic surfactants are excellent additives for forming coal-aqueous mixtures having high coal solids concentrations. It has also been found that polyalkyleneoxide nonionic surfactants of high molecular weight having a hydrophobic portion and a hydrophilic portion, the hydrophilic portion being comprised of at least about 100 ethylene oxide repeating units, provide coal-water dispersions having very high coal solid concentrations of about 70% by weight coal, or higher, when the surfactant is present in an amount sufficient to disperse the particulate coal in water. The resultant mixtures are free-flowing and are adapted to provide coal in a form ready for transport, storage and clean-burning. Surprisingly, the surfactants employed can differ in chemical structure so long as they are of the selected type, are of sufficient molecular weight and are comprised of at least about 100 units of ethylene oxide.

The polyalkyleneoxide nonionic surfactants suitable for use in the invention include the glycol ethers of alkylated phenols having a molecular weight of at least about 4,000 of the general formula:

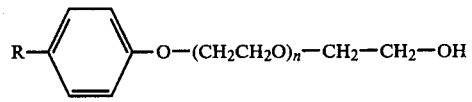

wherein R is substituted or unsubstituted alkyl of from 1 to 18 carbon atoms, preferably 9 carbon atoms; substituted or unsubstituted aryl, or an amino group, and n is an integer of at least about 100. The substituents of the alkyl and aryl radicals can include halogen, hydroxy, and the like.

Other suitable nonionic surfactants are the poly(oxyethylene)-poly(oxypropylene)-poly(oxyethylene) or, as otherwise described, propoxylated, ethoxylated propylene glycol nonionic surfactant block polymers having a molecular weight of at least about 6,000 of the general formula:

$$HO(CH_2CH_2O)_a[CH(CH_3)CH_2O]_b(CH_2CH_2O)_cH$$

wherein a, b and c are whole integers and wherein a and c total at least about 100.

Still other polyalkyleneoxide nonionic surfactants suitable for use in the invention are the block polymers of ethylene and propylene oxide derived from nitrogen-containing compositions such as ethylene diamine and having a molecular weight of at least about 14,000 of the general formula:

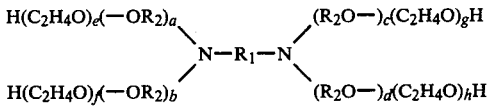

wherein $R_1$ is an alkylene radical having 2 to 5 carbon atoms preferably 2; $R_2$ is alkylene radical having 3 to 5 carbon atoms, preferably 3; a, b, c, d, e, f, g and h are whole integers; and e, f, g and h total at least about 100.

The coal-aqueous mixture compositions of the invention are characterized by having a high coal solids content and a relatively low viscosity of about 2,000 to 6,000 centipoise (cP) or lower as measured by, e.g., in a Brookfield viscometer, model #RVT, fitted with a number 3 spindle, at 100 r.p.m. even at solids levels of 70% by weight, or higher, based on the total weight of the mixture. These compositions can also include amounts of conventional flow modifying materials such as thickeners, glues, defoaming agents, salts, etc., depending upon the use intended.

The products of the invention contain only minor amounts of surfactant additives in the order of about 0.1 to 3.0 percent by weight. They further contain particulate coal as the dispersed solid in an amount from about 45 to 80 percent; water as the carrier medium in an amount of from about 19.9 to 52 percent and, if desired, from about 0.1 to 2 percent of a thickener or thickeners; about 0.1 to 2 percent of a defoaming agent and about 0.1 to 2 percent of salts, caustic or other additive flow control agents, all of the percentages given being based on the total weight of the mixture.

DETAILED DESCRIPTION OF THE INVENTION

The mixtures of the invention are comprised of coal as the dispersed solid material; water as the carrier medium; and a polyalkyleneoxide nonionic surfactant as described herein as the dispersant.

As used herein "polyalkyleneoxide nonionic surfactant" connotes all compositions, compounds, mixtures, polymers, etc. having in whole or in part an alkylene oxide repeating unit of the structure;

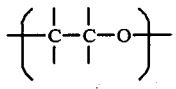

and having a hydrophobic portion and a hydrophilic portion sufficient to render the composition nonionic or substantially nonionic. These surfactants have a polymeric portion comprised of repeating units of ethylene oxide of the general formula:

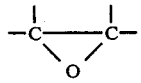

The polyalkyleneoxide nonionic surfactant compositions employed in the invention are of high molecular weight, i.e., from about 4,000 or higher, depending on the particular surfactant employed, and are comprised of at least about 100 repeating units of the ethylene oxide monomer. In addition, the surfactants utilized are nonionic, meaning that they have a hydrophobic portion and hydrophilic portion. Being nonionic these compositions are generally not subject to hydrolysis by aqueous solutions of acid or alkali.

Suitable polyalkyleneoxide nonionic surfactants for use in the invention are the commercially available glycol ethers of alkyl phenols of the following general formula I:

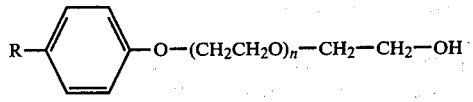

I wherein R is substituted or unsubstituted alkyl of from 1 to 18 carbon atoms, preferably 9 carbon atoms; substituted or unsubstituted aryl, or an amino group, and n is an integer of at least about 100.

These nonionic surfactants are available in a wide array of molecular weights depending primarily on the value of "n", i.e., the number of ethylene oxide repeating units. Surprisingly, it has been found that these surfactants of a high molecular weight of about 4,000 or higher wherein "n" is at least 100, or higher, are particularly effective as dispersants for forming coal-aqueous mixtures to high coal solids concentration requiring little if any further additives, etc., to form highly flowable liquids.

Procedures for the preparation of the glycol ethers of formula I are well known and are described, for example, in U.S. Pat Nos. 2,213,477 and 2,496,582, which disclosures are incorporated herein by reference. Generally, the production of these compositions involves the condensation of substituted phenols with molar proportions of ethylene oxide monomer.

The most preferred glycol ethers of the type generally described in formula I are the nonylphenoxy (polyethyleneoxy) ethanol compositions of the formula:

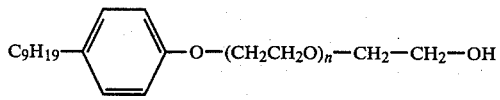

wherein n is about 100 or higher.

Commercially available surfactants of this type are supplied by the GAF Corporation under the designations IGEPAL CO-990 and IGEPAL CO-997. Other commercially available surfactants of this type are supplied by the Thompson-Hayward Chemical Co. under the designation T-Det N-100.

Another group of polyalkyleneoxide nonionic surfactants useful in the invention are the well known poly (oxyethylene)-poly(oxypropylene)-poly(oxyethylene) nonionic surfactant block polymers. These surfactants comprise the block polymers of ethylene oxide and propylene oxide with the repeating units of propylene oxide constituting the hydrophobic portion of the surfactant, and the repeating units of ethylene oxide constituting the hydrophilic portion of the surfactant. These block polymer compositions are of the general formula II:

$$HO(CH_2CH_2O)_a[CH(CH_3)CH_2O]_b(CH_2CH_2O)_cH \qquad II$$

wherein a, b and c are whole integers and wherein a and c total at least about 100.

These compositions can be prepared, and are commercially available, in a variety of molecular weights, depending primarily on the number of repeating units of propylene and ethylene oxide. It has been found that these block polymers having a molecular weight of at least about 6,000 and comprising at least about 100 repeating units of ethylene oxide are excellent additives for dispersing coal in a water carrier to the desired high coal solids concentrations of about 45 to 80 percent, preferably about 70 percent coal particles, based on the weight of the total mixture. Thus with reference to the above formula II, the poly(oxyethylene)-poly(oxypropylene)-poly(oxyethylene) nonionic surfactants suitable for use in the invention are those wherein a and c are integers totaling about 100 or higher.

Suitable procedures for the production of the block polymers of Formula II are described in the patent literature in, for example, U.S. Pat. Nos. 2,674,619; 2,677,700 and 3,101,374, which are incorporated herein by reference.

Generally, these block polymers are prepared by a controlled addition of propylene oxide to the two hydroxyl groups of propylene glycol to form the hydrophobe, followed by the controlled addition of ethylene oxide to "sandwich" in the hydrophobe between the two hydrophilic polyethyleneoxide groups.

The nonionic surfactants of this type (Formula II) having the requisite number of at least 100 units of ethylene oxide are available from the BASF-Wyandotte Corporation under the PLURONIC designation, Series Nos. F-77, F-87, F-68, F-88, F-127, F-98, and F-108. These compositions have at least 100 ethylene oxide units, as per the following table of these PLURONIC surfactants:

| PLURONIC F | Mol. Wt. | % Ethylene Oxide | Number of Ethylene Oxide Units |
|---|---|---|---|
| F-77 | 6,600 | 70 | 105 |
| F-87 | 7,700 | 70 | 120 |
| F-68 | 8,350 | 80 | 151 |
| F-88 | 10,800 | 80 | 195 |
| F-127 | 12,500 | 70 | 200 |
| F-98 | 13,000 | 80 | 235 |
| F-108 | 14,000 | 80 | 255 |

Another group of polyalkyleneoxide nonionic surfactants suitable as coal dispersants are the nitrogen containing block polymers of the general formula III:

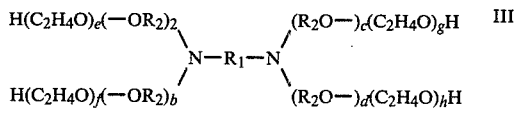

wherein $R_1$ is an alkylene radical having 2 to 5 carbon atoms, preferably 2; $R_2$ is an alkylene radical having 3 to 5 carbon atoms, preferably 3; a, b, c, d, e, f, g and h are whole integers; and e, f, g and h total at least about 100.

These materials are prepared by the addition of a $C_3$ to $C_5$ alkylene oxide to an alkylene diamine under conditions to add two polyoxyalkylene groups to each of the nitrogen groups in the presence of a catalyst so as to polymerize the oxyalkylene groups into the desired long-chained polyoxyalkylene radicals. After the desired addition and polymerization of the $C_3$ to $C_5$ alkylene oxide group has been completed, ethylene oxide is introduced and is added to the polyoxyalkylene groups to impart the desired hydrophilic characteristics to the compound. The preparation of these materials from commercially available alkylene diamines and alkylene oxides is known in the art.

In general, the agents are prepared by mixing the $C_3$ to $C_5$ alkylene oxide with the alkylene diamine at atmospheric or elevated pressures, at temperatures between about 50° to 150° centigrade and in the presence of an alkaline catalyst such as an alkali metal hydroxide or alcoholate. The degree of polymerization or the size of the hydrophobic group is controlled by the relative proportions of $C_3$ to $C_5$ alkylene oxide and alkylene diamine, the alkylene oxide being introduced in a sufficient quantity to obtain a hydrophobic base weight of about 2000 to 3600 units although other weights can be provided.

These surfactants (Formula III) having the requisite number of at least 100 ethylene oxide repeating units are available from the BASF Wyandotte Chemicals Corporation under the TETRONIC designations Series Nos. 1107; 1307; 908 and 1508. These compositions have at least 100 ethylene oxide units, as per the following table of these TETRONIC surfactants.

| TETRONIC | Mol. Wt. | % Ethylene Oxide | Number of Ethylene Oxide Repeating Units |
|---|---|---|---|
| 1107 | 14,500 | 70 | 230 |
| 1307 | 15,500 | 70 | 245 |
| 908 | 16,500 | 80 | 300 |

-continued

| TETRONIC | Mol. Wt. | % Ethylene Oxide | Number of Ethylene Oxide Repeating Units |
|---|---|---|---|
| 1508 | 17,000 | 80 | 309 |

Any of a wide array of coals can be used to form the coal-aqueous mixtures of the invention, including anthracite, bituminous, sub-bituminous, mine tailings, fines, lignite and the like. Other finely divided solid carbonaceous materials may be used, e.g., coke, prepared either from coal or from petroleum.

To form the coal-aqueous mixtures coal is pulverized to approximately 90% finer than a 200 mesh Tyler Standard screen size, although courser or finer particle sizes can be employed, if desired.

Advantageously, according to the invention, the untreated pulverized raw coal, is beneficiated, i.e., cleaned of amounts of ash and sulfur. The art will appreciate that mixtures formed of beneficiated coal offer considerable advantage. They are clean burning or relatively clean burning, and are more suited for burning in apparatus for powering utilities, home burners and the like without undue burdensome and expensive cleaning apparatus.

Any of a wide array of beneficiating treatments can be employed in preparing the particulate coals, including conventional heavy-media separations, magnetic separation and the like. The preferred method for providing the beneficiated coal particles is by a chemical treatment process. The preferred chemical treatment process employs an in situ chemical treatment and separation technique to beneficiate coal. The process is described in U.S. patent applications Ser. Nos. 114,357 and 114,414 both filed Jan. 22, 1980; in the application titled "Process for Forming Coal-Oil Mixtures Under Selected Conditions of Temperature and Shear", attorney docket No. 22,613, and in the Government Report No. 2694, titled "Fuel Extension by Dispersion of Clean Coal in Oil", each of which disclosures are incorporated herein by reference to avoid needless duplication.

Generally, according to the preferred chemical treatment method, raw as-mined coal is ground in the presence of water to a particle size of about 200 mesh. The ground coal is treated in an aqueous medium with a monomeric compound, generally an unsaturated polymerizable composition such as readily available tall oil in the presence of a metal initiator such as cupric nitrate; a catalyst such as hydrogen peroxide and minor amounts of fuel oil, all in an aqueous phase are also present. The ground coal so treated is made hydrophobic and oileophilic and is separated from the unwanted ash and sulfur by a froth flotation technique.

The cleaned coal recovered from the preferred chemical treatment process, now in the form of beneficiated coal particles, is suited for the coal-aqueous mixtures of the invention. These coal particles are characterized by having an ash content reduced to levels of about 0.5 to 6.0% and a sulfur content reduced to levels of about 0.5 to 2.0% and have about 0.1 to 5.0 percent by weight of the polymer coating, or otherwise associated with the coal particle surface. Generally, the polymer is comprised of units of the unsaturated monomer.

It is preferred to form the coal-aqueous mixtures by first adding the surfactant to water together with other additives such as conventional defoaming agents, if desired. This admixing can be done with stirring at conditions of atmospheric or nearly atmospheric temperature and pressure. Thereafter, the particulate coal, preferably beneficiated coal particles, is added to the mixture to produce a coal-aqueous mixture of high coal solids content of about 45 to 80% by weight coal based in the total weight of the mixture at atmospheric or nearly atmospheric temperatures and pressures. If desired, thickeners can then be added to further stabilize the mixture to assist in preventing the coal particles from settling when the mixture is to be stored for extended periods. Caustic soda or other bases can also be added at this point. As will be apparent, adding thickeners in the final stage is preferred so that the stirring requirements are kept at a minimum. The coal-aqueous mixtures can be prepared in a batch operation or in the continuous mode. In continuous production, the coal can be admixed with water in a first stage along with other flow control agents such as the surfactant. The compositions of the first stage can then be transferred continuously to a second stage wherein the thickener is added. Again, adding the thickener at the later stage results in reduced stirring requirements.

As indicated above, the additives that can be added to the coal-aqueous mixture can include defoaming agents, thickeners, salts, bases, other flow modifying agents and combinations of these materials.

Generally, the defoaming agents that can be used are conventional and include both silicon and non-silicon containing compositions. A commercially available defoaming agent suitable for use in the mixtures is COLLOID 691, supplied by Colloids, Inc. This composition generally comprises a mixture containing mineral oil, amide and an ester.

The thickeners that can be added to the mixture are also conventional. They are added to increase the non-settling characteristics of the composition. Suitable thickeners include xanthan gum, guar gum, glue, or combinations of these materials, in amounts ranging from about 0.01 to 3.0% by weight, based in the total weight of the mixture.

In preparing the compositions containing the preferred 70% by weight coal, based on the weight of the total mixture, the polyalkyleneoxide nonionic surfactants are preferably mixed with water in a proportion of about 0.3 part by weight surfactant to 29.3 parts by weight water at atmospheric or nearly atmospheric temperatures and pressures. A defoaming agent in an amount of 0.03 part by weight can be added to the water at this point to assist in processing. The pulverized coal is then mixed with the water in a proportion of 70 parts by weight coal to 29.3 parts by weight of water to obtain a flowable liquid. If desired, to the mixture can then be added about 0.15 part of a thickener or thickeners to provide protection against settling. Other additives such as salts or bases can also be added in about 0.2 part by weight of the total mixture to assist in dispersing the coal.

The following examples will further illustrate the invention:

EXAMPLE 1

Preparation of a coal-aqueous mixture.

A coal-aqueous mixture using unbeneficiated particulate coal is prepared of the following composition.

| Component | Weight % |
|---|---|
| Particulate Coal[1] | 70.00 |

-continued

| Component | Weight % |
|---|---|
| Water[2] | 29.37 |
| Salt[3] | 0.6 |
| Defoaming Agent[4] | 0.3 |
| Polyethyleneoxide nonionic surfactant having 100 ethylene oxide repeating units and a molecular weight of 4680[5] | 0.57 |

[1]Pocohontas seam coal
[2]Industrial water
[3]Industrial grade sodium chloride
[4]COLLOID 691 from Colloids, Inc., Newark, N.J.
[5]IGEPAL CO-997 from the GAF Corporation, N.Y., N.Y.

The coal is ground to about 90 percent finer than 200 mesh Tyler Standard screen size. The surfactant, defoaming agent, and salt in the amounts specified are added to the 29.37 grams of water in a Hi-Vispresator high-speed disperser available from the Premium Mill Co., equipped with a 1¾ inches Cowles-type blade operating at 2000 r.p.m. The disperser is operated at atmospheric temperature and pressure. The particulate coal is then added to the mixture with continued mixing.

The mixture is seen to disperse the entire 70% by weight coal and is observed to be free flowing.

EXAMPLE 2

Preparation of a coal-aqueous mixture.

A coal-aqueous mixture using another unbeneficiated particulate coal is prepared of the following composition.

| Component | Weight % |
|---|---|
| Particulate Coal[1] | 70.00 |
| Water[2] | 29.46 |
| Salt[3] | 0.6 |
| Defoaming Agent[4] | 0.03 |
| Polyethyleneoxide nonionic surfactant having 245 ethylene oxide repeating units and a molecular weight of 15,500[5] | 0.45 |

[1]Pocohontas seam coal
[2]Industrial water
[3]Industrial grade sodium chloride
[4]COLLOID 691 from Colloids, Inc., Newark N.J.
[5]TETRONIC 1307 from BASF Wyandotte Chemicals, Corp., Parsippany, N.J.

The coal is ground to about 90% finer than 200 mesh Tyler Standard screen size. The surfactant, defoaming agent, and salt in the amounts specified are added to the 29.46 grams of water in a high speed disperser equipped with a 1¾ inches Cowles-type blade operating at 2000 r.p.m. The particulate coal is then added to the mixture with continued mixing. The vessel is operated at atmospheric temperature and pressure.

The mixture is seen to disperse the entire 70% by weight coal and is observed to be free flowing.

EXAMPLE 3

Preparation of particulate cleaned coal.

200 grams of Pittsburgh seam coal having 6.3% ash content and a 1.5% sulfur content based on the weight of dry coal was pulverized in the presence of water to a 200 mesh Tyler Standard size using a ball mill grinding unit. The coal was then transferred to a mixing vessel. Into this vessel was also introduced 0.03 gram of corn oil, 5.0 grams of No. 2 fuel oil, 1.0 cubic centimeter of a 5% solution of hydrogen peroxide in water; 2.0 cubic centimeters of a 5.0% solution of cupric nitrate in water and 200 grams of the 200 mesh coal. The mixture was stirred and heated to 86° F. for 2 minutes. The mixture was sprayed into the water surface and a frothing ensued. Coal, in the froth phase, having a 3.4% ash and 0.9% sulfur and having a polymeric coating of about 0.15%, based on the weight of dry coal was skimmed from the surface of the water and recovered. The water phase containing large amounts of ash and sulfur was discarded.

The recovered coal was slightly dried using a Buchner filter drying unit.

EXAMPLE 4

Preparation of a coal-aqueous mixture.

Beneficiated coal, treated in accordance with the procedure of Example 3, was formed into a coal-aqueous mixture of the following composition.

| Component | Weight % |
|---|---|
| Particulate Coal[1] | 70.21 |
| Water[2] | 29.04 |
| Xanthan gum[3] | 0.06 |
| Guar gum[4] | 0.03 |
| Salt[5] | 0.06 |
| Defoaming Agent[6] | 0.03 |
| Polyethlyeneoxide nonionic surfactant having about 100 repeating units of ethylene oxide and a molecular weight of about 4680[7] | 0.57 |

[1]Pocohontas seam coal cleaned in accordance with the teachings of Example 3. The weight percent given being on a moisture free basis.
[2]Industrial water
[3]BIOZAN SPX-5423, Hercules Inc., Wilmington, Delaware
[4]GUAR THKX-225, Hercules Inc., Wilmington, Delaware
[5]Industrial grade sodium chloride
[6]COLLOID 691 from Colloids, Inc., Newark, N.J.
[7]IGEPAL CO-997 from the GAF Corporation, N.Y., N.Y.

The surfactant, defoaming agent and salt in the amounts specified were added to the 29.04 grams of water in a high speed disperser equipped with a 1¾ inches Cowles-type blade operated at 2000 r.p.m. The disperser was operated at atmospheric temperature and pressure. The particulate coal was then added to the mixture with continued mixing at 4500 r.p.m. To the mixture was then added the xanthan gum and guar gum thickeners with mixing at 4500 r.p.m.

The mixture was observed to disperse the entire 70.21 wt. % coal particles and was observed to be free flowing. The viscosity was measured with a Brookfield viscometer model #RVT and found to be 2000 cP at 100 r.p.m. using a #3 spindle.

EXAMPLE 5

Preparation of a coal-aqueous mixture.

Beneficiated coal, treated in accordance with the procedure of Example 3, was formed into a coal-aqueous mixture of the following composition.

| Component | Weight % |
|---|---|
| Particulate Coal[1] | 70.0 |
| Water[2] | 29.56 |
| Xanthan gum[3] | 0.06 |
| Guar gum[4] | 0.03 |
| Amino-hydroxy material[5] | 0.05 |
| Defoaming Agent[6] | 0.03 |
| Polyethlyeneoxide nonionic surfactant having about 245 repeating units of ethylene oxide and a molecular | 0.30 |

-continued

| Component | Weight % |
|---|---|
| weight of about 15,500[7] | |

[1]Pocohontas seam coal cleaned in accordance with the teachings of Example 3. The weight percent given being on a moisture free basis.
[2]Industrial water
[3]KELZAN, Kelco Co., division of Merck & Co., Inc., San Diego, California
[4]GUAR THKX-225, Hercules Inc., Wilmington, Delaware
[5]AMP-95 International Minerals & Chemical Corp., Des Plains, Illinois
[6]COLLOID 691 from Colloids, Inc., Newark, N.J.
[7]TETRONIC 1307 from BASF Wyandotte Chemicals, Corp., Parsippany, N.J.

The surfactant and defoaming agent in the amounts specified were added to the 29.56 grams of water in a high speed disperser equipped with a 1¾ inches Cowles-type blade operated at 2000 r.p.m. The disperser was operated at atmospheric temperature and pressure. The particulate coal was then added to the mixture with continued stirring at 4500 r.p.m. To the mixture was then added the xanthan gum and guar gum thickeners while mixing at 4500 r.p.m.

The mixture was observed to disperse the entire 70.00 wt. % coal particles and was observed to be free flowing. The viscosity was measured with a Brookfield viscometer model #RVT and found to be 2000 cP at 100 r.p.m. using a #3 spindle.

EXAMPLES 6–14

These examples compare mixtures which can be prepared to high coal solids concentrations utilizing polyalkyleneoxide nonionic surfactants having a high molecular weight and at least 100 repeating units of ethylene oxide with compositions which do not disperse the coal to high solid levels using similar surfactants, but which do not have the required 100 repeating units of ethylene oxide and high molecular weight.

In each example the same or substantially the same amounts of particulate coal, water, thickeners, salt and defoaming agents were used and a similar surfactant was used, i.e., a poly(oxyethylene)-poly(oxypropylene)-poly(oxyethylene) surfactant, except that the different surfactants tested had different molecular weights and a different number of ethylene oxide repeating units.

The mixtures were each prepared in accordance with the procedures of Example 4. The surfactant, defoaming agent, and salt in the amount specified were added to water in a high speed disperser equipped with a 1¾ inches Cowles-type blade operated at 2000 r.p.m. The disperser was operated at atmospheric temperature and pressure. The particulate coal was then added to the mixture with continued mixing. To the mixture was then added the xanthan gum and guar gum thickeners in the stated amounts with mixing.

The following table A tabulates the results of Examples 6–14 showing that coal dispersions of high solid concentrations were prepared utilizing the poly(oxyethylene)-poly(oxypropylene)-poly(oxyethylene) surfactants having the requisite 100 repeating units of ethylene oxide and a molecular weight in excess of 6000, whereas, the same amount or substantially the same amount of coal was not fully dispersed utilizing surfactants not having the requisite 100 repeating units of ethylene oxide and high molecular weight.

TABLE A

| | Examples | | | | | | | | | Mol. | Ethylene Oxide |
|---|---|---|---|---|---|---|---|---|---|---|---|
| Components (grams) | 6 | 7 | 8 | 9 | 10 | 11 | 12 | 13 | 14 | Wt. | Repeating Units |
| Particulate coal[1] | 272.0 | 272.0 | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | 0.1 | 0.1 | | |
| PLURONICS - L35 | 2.0 | — | — | — | — | — | — | — | — | 1,900 | 20 |
| PLURONIC - F38 | — | 2.0 | — | — | — | — | — | — | — | | |
| 5,000 | 90 | | | | | | | | | | |
| PLURONICS - F77 | — | — | 1.1 | — | — | — | — | — | — | 6,600 | 105 |
| PLURONICS - F87 | — | — | — | 1.1 | — | — | — | — | — | 7,700 | 120 |
| PLURONICS - F68 | — | — | — | — | 1.1 | — | — | — | — | 8,350 | 151 |
| PLURONICS - F88 | — | — | — | — | — | 1.1 | — | — | — | 10,800 | 195 |
| PLURONICS - F127 | — | — | — | — | — | — | 1.1 | — | — | 12,500 | 200 |
| PLURONICS - F98 | — | — | — | — | — | — | — | 1.1 | — | 13,000 | 235 |
| PLURONICS - F108 | — | — | — | — | — | — | — | — | 1.1 | 14,000 | 255 |
| Mixture viscosity in cP at 100 r.p.m. using a #3 spindle. | N.I. | N.I. | 5400 | 3850 | 5900 | 3800 | 3500 | 3600 | 3000 | | |

[1]Pocohontas seam coal cleaned in accordance with the teachings of Example 3 and containing 10% moisture
[2]Industrial water
[3]BIOZAN SPX-5423, Hercules Incorporated, Wilimington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I.—The amount of coal specified was not fully incorporated into the water.

EXAMPLES 15–21

These examples compare mixtures which can be prepared to high coal solid concentrations utilizing polyalkyleneoxide nonionic surfactants having a high molecular weight and at least 100 repeating units of ethylene oxide with compositions which do not disperse the coal to high solid levels using similar surfactants but which do not have the required 100 repeating units of ethylene oxide and high molecular weight.

In each example the same amounts or substantially the same amounts of particulate coal, water, thickeners, salt and defoaming agents were used and a similar surfactant was used, i.e., nitrogen containing block polymers of propylene and ethylene oxide, except that the different surfactants tested had different molecular weights and a different number of ethylene oxide repeating units.

The mixtures were each prepared in accordance with the procedures of Example 4. The surfactant, defoaming agent, and salt in the amount specified were added to water in a high speed disperser equipped with a 1¾ inches Cowles-type blade operated at 4500 r.p.m. The disperser was operated at atmospheric temperature and pressure. The particulate coal was then added to the mixture with continued mixing. To the mixture was then added the xanthan gum and guar gum thickeners in the stated amounts with mixing.

The following table B tabulates the results of Examples 15–21 showing that coal dispersions of high solid concentrations were prepared utilizing the nitrogen containing propylene and ethylene oxide block polymer surfactants having the requisite 100 repeating units of ethylene oxide and a molecular weight in excess of 14000, whereas, the same amount of coal was not dispersed utilizing surfactants not having the requisite 100 repeating units of ethylene oxide and high molecular weight.

TABLE B

| Components (grams) | Examples 15 | 16 | 17 | 18 | 19 | 20 | 21 | Mol. Wt. | Ethylene Oxide Repeating Units |
|---|---|---|---|---|---|---|---|---|---|
| Particulate coal[1] | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | | |
| TETRONIC - 304 | 1.3 | — | — | — | — | — | — | 1,650 | 15 |
| TETRONIC - 504 | — | 1.3 | — | — | — | — | — | 3,400 | 30 |
| TETRONIC - 704 | — | — | 1.3 | — | — | — | — | 5,500 | 50 |
| TETRONIC - 1107 | — | — | — | 1.3 | — | — | — | 14,500 | 230 |
| TETRONIC - 1307 | — | — | — | — | 1.3 | — | — | 15,500 | 245 |
| TETRONIC - 908 | — | — | — | — | — | 1.3 | — | 16,500 | 300 |
| TETRONIC - 1508 | — | — | — | — | — | — | 1.3 | 17,000 | 309 |
| Mixture viscosity in cP at 100 r.p.m. using a #3 spindle | N.I. | N.I. | N.I. | 3100 | 3700 | 3200 | 2750 | | |

[1]Pocohontas seam coal cleaned in accordance with the teachings of Example 3 and containing 10% moisture
[2]Industrial water
[3]BIOZAN SPX-5423, Hercules Incorporated, Wilmington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I.—The amount of coal specified was not fully incorporated into the water.

EXAMPLES 22–28

These examples compare mixtures which can be prepared to high coal solid concentrations utilizing polyalkyleneoxide nonionic surfactants having a high molecular weight and at least 100 repeating units of ethylene oxide with compositions which do not disperse the coal to high solid levels using similar surfactants but which do not have the required 100 repeating units of ethylene oxide and high molecular weight.

In each example the same amounts or substantially the same amounts of particulate coal, water, thickeners, salt and defoaming agents were used and a similar surfactant was used, i.e., a glycol ether of an alkylated phenol, except that the different surfactants tested had different molecular weights and a different number of ethylene oxide repeating units.

The mixtures were each prepared in accordance with the procedures of Example 4. The surfactant, defoaming agent, and salt in the amount specified were added to water in a high speed disperser equipped with a $1\frac{3}{4}$ inches Cowles-types blade operated at 4500 r.p.m. The disperser was operated at atmospheric temperature and pressure. The particulate coal was then added to the mixture with continued mixing. To the mixture was then added the xanthan gum and guar gum thickeners in the stated amounts with mixing.

The following table C tabulates the results of Examples 22–28 showing that coal dispersions of high solid concentrations were prepared utilizing the glycol ether of alkylated phenol surfactants having the requisite 100 repeating units of ethylene oxide and a molecular weight in excess of 4000, whereas, the same amount or substantially the same amount of coal was not fully dispersed utilizing surfactants not having the requisite 100 repeating units of ethylene oxide and high molecular weight.

TABLE C

| Components (grams) | Examples 22 | 23 | 24 | 25 | 26 | 27 | 28 | Mol. Wt. | Ethylene Oxide Repeating Units |
|---|---|---|---|---|---|---|---|---|---|
| Particulate coal[1] | 272.0 | 272.0 | 272.0 | 272.0 | 272.0 | 272.0 | 272.0 | | |
| Water[2] | 74.0 | 74.0 | 74.0 | 74.0 | 74.0 | 74.0 | 74.0 | | |
| Xanthan gum[3] | 0.2 | 0.2 | 0.2 | 0.2 | 0.2 | 0.2 | 0.2 | | |
| Guar gum[4] | 0.1 | 0.1 | 0.1 | 0.1 | 0.1 | 0.1 | 0.1 | | |
| Salt[5] | 0.2 | 0.2 | 0.2 | 0.2 | 0.2 | 0.2 | 0.2 | | |
| Defoaming Agent[6] | 0.1 | 0.1 | 0.1 | 0.1 | 0.1 | 0.1 | 0.1 | | |
| IGEPAL - CO-630 | 1.4 | — | — | — | — | — | — | 720 | 10 |
| IGEPAL - CO-730 | — | 1.4 | — | — | — | — | — | 940 | 15 |
| IGEPAL - CO-850 | — | — | 1.4 | — | — | — | — | 1,160 | 20 |
| IGEPAL - CO-887 | — | — | — | 2.0 | — | — | — | 1,600 | 30 |
| IGEPAL - CO-897 | — | — | — | — | 2.0 | — | — | 2,040 | 40 |
| IGEPAL - CO-977 | — | — | — | — | — | 2.0 | — | 2,480 | 50 |
| IGEPAL - CO-997 | — | — | — | — | — | — | 2.0 | 4,680 | 100 |
| Mixture viscosity in cP at 100 r.p.m. | | | | | | | | | |

TABLE C-continued

| Components (grams) | Examples 22 | 23 | 24 | 25 | 26 | 27 | 28 | Mol. Wt. | Ethylene Oxide Repeating Units |
|---|---|---|---|---|---|---|---|---|---|
| using a #3 spindle | N.I. | N.I. | N.I. | N.I. | N.I. | N.I | 2000 | | |

[1]Pocohontas seam coal cleaned in accordance with the teachings of Example 3 and containing 10% moisture
[2]Industrial water
[3]BIOZAN SPX-5423, Hercules Incorporated, Wilmington, Delaware
[4]GUAR THKX-225, Hercules Incorporated, Wilmington, Delaware
[5]Industrial grade sodium chloride
[6]COLLOID 691 from Colloids, Inc., Newark, N.J.
N.I.—The amount of coal specified was not fully incorporated into the water.

As the Examples show, coal-aqueous mixtures are provided having high coal solids content. The resultant mixtures are stable, have low viscosity and incorporate large amounts of solid coal particles, typically 70% by weight coal or higher. Examples 6–14 demonstrate that polyalkylene oxide nonionic surfactants of high molecular weight of at least 6000 and having at least 100 repeating units of ethylene oxide units are excellent dispersants for forming coal aqueous mixtures. Examples 6 to 14 further demonstrate that for the surfactants of the same basic structure, i.e., block polymers of propylene and ethylene oxide, advantageous results are achieved by employing the composition of a molecular weight of 6000 or higher having at least 100 repeating units of ethylene oxide.

Similarly, Examples 15 to 21 demonstrate that for the polyalkyleneoxide nonionic surfactants of the block polymer type derived from nitrogen containing compositions such as ethylene diamine, compositions of 14,000 molecular weight or higher having 100 repeating units of ethylene oxide provide the same or nearly the same advantageous results. Similarly, as Examples 22–28 show the glycol ether of alkylated phenol surfactants having the 100 repeating units of ethylene oxide and high molecular weight also are excellent coal dispersants.

From the foregoing it will be seen that coal-aqueous mixtures are provided having significantly high solid concentrations. The mixtures can be provided in a clean form ready for burning in utility burners, home burners and the like with little if any need for additional cleaning to remove ash and sulfur.

Thus, while I have fully described an embodiment of the foregoing invention, it is to be understood this description is offered by way of illustration only. The range of adaptability of the process presented herein is contemplated to include many variations and adaptations of the subject matter within the scope of the production of coal-aqueous mixtures. And it is to be understood that this invention is to be limited only by the scope of the appended claims.

I claim:

1. A coal-aqueous mixture consisting essentially of: particulate coal as a dispersed solid material; water as a carrier medium; and a polyalkyleneoxide nonionic surfactant having a hydrophobic portion and a hydrophilic portion, said hydrophilic portion comprising at least about 100 units of ethylene oxide, said polyalkyleneoxide nonionic surfactant being present in said mixture in an amount sufficient to disperse said particulate coal in said water carrier.

2. The mixture of claim 1 wherein said particulate coal is present in an amount from about 45 to 80 percent; said water is present in an amount from about 19.9 to 52 percent; and said polyalkyleneoxide nonionic surfactant is present in an amount from about 0.1 to 3.0 percent, based on the total weight of the mixture.

3. The mixture of claim 1 wherein said polyalkyleneoxide nonionic surfactant has a high molecular weight at least about 4000.

4. A mixture as defined in claim 1 wherein said polyalkyleneoxide nonionic surfactant comprises a composition of the formula

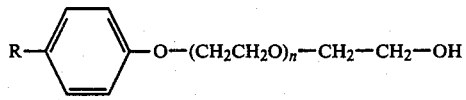

wherein R is substituted or unsubstituted alkyl of from 1 to 18 carbon atoms; substituted or unsubstituted aryl or an amino group, and n is an integer of at least about 100.

5. A mixture as defined in claim 4 wherein R is a nonyl alkyl group.

6. A mixture as defined in claim 4 wherein said polyalkylenoxide nonionic surfactant has a molecular weight of at least about 4000.

7. A mixture as defined in claim 1 wherein said polyalkyleneoxide nonionic surfactant comprises a composition of the formula $$HO(CH_2CH_2O)_a[CH(CH_3)CH_2O]_b(CH_2CH_2O)_cH$$

wherein a, b and c are whole integers totaling at least about 100.

8. A mixture as defined in claim 7 wherein said polyalkyleneoxide nonionic surfactant has a molecular weight of at least about 6000.

9. A mixture as defined in claim 1 wherein said polyalkyleneoxide nonionic surfactant comprises a composition of the formula

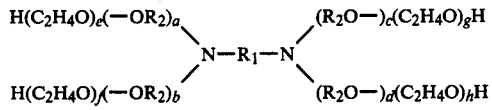

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100.

10. A mixture as defined in claim 9 wherein $R_1$ is an alkylene radical having 2 carbon atoms and $R_2$ is an alkylene radical having 3 carbon atoms.

11. A mixture as defined in claim 1 further containing a thickening agent.

12. A mixture as defined in claim 11 wherein said thickening agent is selected from the group consisting of xanthan gum, guar gum, cellulose gum and glue.

13. A mixture as defined in claim 11 where said thickening agent comprises from about 0.01 to 3 percent by weight of the total mixture.

14. A mixture as defined in claim 1 further containing a defoaming agent.

15. A mixture as defined in claim 14 wherein said defoaming agent comprises a mixture of mineral oil, amide and an ester.

16. A mixture as defined in claim 1 further containing a salt or a base.

17. A mixture as defined in claim 16 wherein said salt is sodium chloride.

18. A mixture as defined in claim 1 wherein said particulate coal is beneficiated.

19. A mixture as defined in claim 1 wherein said particulate coal is about 200 mesh in Tyler Standard screen size.

20. A mixture as defined in claim 1 wherein said particulate coal is characterized by having a sulfur content of from 0.5 to 2.0 percent by weight, and an ash content of from about 0.5 to 6.0 percent, based on the weight of dry coal.

21. A mixture as defined in claim 20 wherein said particulate coal has a coating comprised of a polymer of an unsaturated monomer.

22. A mixture as defined in claim 21 wherein said coating is in an amount of from about 0.1 to 5.0 percent by weight, based on the weight of dry coal.

23. A mixture as defined in claim 21 wherein said unsaturated monomer is a tall oil.

24. A mixture as defined in claim 20 wherein said particulate coal further includes a minor amount of fuel oil.

25. A method for forming a coal-aqueous mixture comprising: admixing particulate coal with ingredients consisting essentially of water and a polyalkyleneoxide nonionic surfactant having a hydrophobic portion and a hydrophilic portion, said hydrophilic portion being comprised of at least about 100 units of ethylene oxide.

26. The method of claim 25 wherein said polyalkyleneoxide nonionic surfactant is of the general formula:

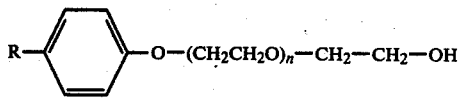

wherein R is a substituted or unsubstituted alkyl of from 1 to 18 carbon atoms; substituted or unsubstituted aryl or an amino group and n is an integer of at least about 100.

27. The method of claim 25 wherein said polyalkyleneoxide nonionic surfactant is of the formula:

$$HO(CH_2CH_2O)_a[CH(CH_3)CH_2O]_b(CH_2CH_2O)_cH$$

wherein a, b and c are whole integers totaling at least about 100.

28. The method of claim 25 wherein said polyalkyleneoxide nonionic surfactant is of the formula:

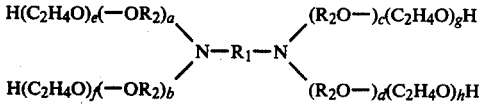

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100.

29. The method of claim 25 wherein a thickening agent is added to said coal-aqueous mixture.

30. The method of claim 29 wherein said thickening agent is selected from the group consisting of xanthan gum, guar gum, cellulose gum and glue.

31. The method of claim 25 wherein a defoaming agent is added to said coal-aqueous mixture.

32. The method of claim 31 wherein said defoaming agent comprises a mixture of mineral oil, amide and polyethylene glycol oleate ester.

33. The method of claim 25 wherein a salt is added to said coal-aqueous mixture.

34. The method of claim 33 wherein said salt is sodium chloride.

35. The method of claim 25 wherein a caustic is added to the mixture.

36. The method of claim 25 wherein said coal-aqueous mixture is prepared in a continuous operation.

37. The method of claim 36 wherein said continuous operation for preparing said coal-aqueous mixture comprises first admixing said particulate coal with said water and said polyalkyleneoxide nonionic surfactant in a first stage and thereafter adding a thickener in a second stage.

38. A coal-aqueous mixture consisting essentially of: particulate coal as a dispersed solid material; water as a carrier medium; and a polyalkyleneoxide nonionic surfactant selected from the group consisting of a composition of the formula

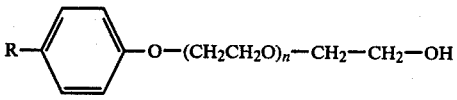

wherein R is substituted or unsubstituted alkyl of from 1 to 18 carbon atoms; substituted or unsubstituted aryl or an amino group, and n is an integer of at least about 100, a composition of the formula

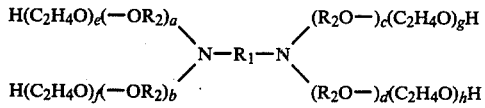

wherein $R_1$ is an alkylene radical having 2 to 5 carbon atoms; $R_2$ is an alkylene radical having 3 to 5 carbon atoms; a, b, c, d, e, f, g and h are whole integers and e, f, g and h total at least about 100 and a compound of the formula $$HO(CH_2CH_2O)_a[CH(CH_3)CH_2O]_b(CH_2CH_2O)_cH$$

wherein a, b and c are whole integers totaling at least about 100.

39. The coal-aqueous mixture of claim 38 wherein said particulate coal is present in an amount from about 45 to 80 percent; said water is present in an amount from about 19.9 to 52 percent; and said polyalkyleneoxide nonionic surfactant is present in an amount from about 0.1 to 3.0 percent, based on the total weight of the mixture.

40. The coal-aqueous mixture of claim 38 wherein said polyalkyleneoxide nonionic surfactant has a high molecular weight at least about 4000.

41. The coal-aqueous mixture as defined in claim 38 wherein R is a nonyl alkyl group.

42. The coal-aqueous mixture as defined in claim 38 wherein $R_1$ is an alkylene radical having 2 carbon atoms and $R_2$ is an alkylene radical having 3 carbon atoms.

43. The coal-aqueous mixture as defined in claim 38 wherein said polyalkyleneoxide nonionic surfactant having the formula $$HO(CH_2CH_2O)_a[CH(CH_3)CH_2O]_b(CH_2CH_2O)_cH$$

has a molecular weight of at least about 6000.

44. The coal-aqueous mixture as defined in claim 38 further comprising a thickening agent.

45. The coal-aqueous mixture as defined in claim 44 wherein said thickening agent is selected from the group consisting of xanthan gum, guar gum, cellulose gum and glue.

46. The coal-aqueous mixture as defined in claim 44 where said thickening agent comprises from about 0.01 to 3 percent by weight of the total mixture.

47. The coal-aqueous mixture as defined in claim 38 further containing a defoaming agent.

48. The coal-aqueous mixture as defined in claim 47 wherein said defoaming agent comprises a mixture of mineral oil, amide and an ester.

49. The coal-aqueous mixture as defined in claim 38 further containing a salt or a base.

50. The coal-aqueous mixture as defined in claim 49 wherein said salt is sodium chloride.

51. The coal-aqueous mixture as defined in claim 38 wherein said particulate coal is beneficiated.

52. The coal-aqueous mixture as defined in claim 38 wherein said particulate coal is about 200 mesh in Tyler Standard screen size.

53. The coal-aqueous mixture as defined in claim 38 wherein said particulate coal is characterized by having a sulfur content of from 0.5 to 2.0 percent by weight, and an ash content of from about 0.5 to 6.0 percent, based on the weight of dry coal.

54. The coal-aqueous mixture as defined in claim 53 wherein said particulate coal has a coating comprised of a polymer of an unsaturated monomer.

55. The coal-aqueous mixture as defined in claim 54 wherein said coating is in an amount of from about 0.1 to 5.0 percent by weight, based on the weight of dry coal.

56. The coal-aqueous mixture as defined in claim 54 wherein said unsaturated monomer is a tall oil.

57. The coal-aqueous mixture as defined in claim 54wherein said particulate coal further includes a minor amount of fuel oil.

* * * * *